US007988475B2

(12) United States Patent
Sakakura

(10) Patent No.: US 7,988,475 B2
(45) Date of Patent: Aug. 2, 2011

(54) CONNECTOR ASSEMBLY WITH GUIDE PROJECTIONS

(75) Inventor: Kouji Sakakura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/755,056

(22) Filed: Apr. 6, 2010

(65) Prior Publication Data

US 2010/0261365 A1 Oct. 14, 2010

(30) Foreign Application Priority Data

Apr. 13, 2009 (JP) ..... 2009-096814

(51) Int. Cl.
*H01R 13/52* (2006.01)

(52) U.S. Cl. ..... 439/271; 439/589; 439/801

(58) Field of Classification Search ..... 439/271, 439/364, 801, 589, 98
See application file for complete search history.

(56) References Cited

U.S. PATENT DOCUMENTS

| | | | | |
|---|---|---|---|---|
| 6,716,071 | B2 * | 4/2004 | Miyazaki | 439/859 |
| 6,814,617 | B2 * | 11/2004 | Oota et al. | 439/589 |
| 7,101,217 | B2 * | 9/2006 | Hayashi | 439/447 |
| 7,401,792 | B2 * | 7/2008 | Smirra | 277/616 |
| 7,597,589 | B2 * | 10/2009 | Kawamura | 439/595 |
| 7,614,910 | B2 * | 11/2009 | Croteau et al. | 439/573 |
| 7,811,116 | B2 * | 10/2010 | Sakakura et al. | 439/364 |
| 2010/0009566 | A1 * | 1/2010 | Sakakura et al. | 439/364 |
| 2010/0216323 | A1 * | 8/2010 | Kawamura et al. | 439/95 |
| 2010/0261363 | A1 * | 10/2010 | Sakakura | 439/271 |
| 2010/0261364 | A1 * | 10/2010 | Matsuoka | 439/271 |

FOREIGN PATENT DOCUMENTS

JP 2006-31962 2/2006

* cited by examiner

*Primary Examiner* — Hae Moon Hyeon
(74) *Attorney, Agent, or Firm* — Gerald E. Hespos; Michael J. Porco

(57) ABSTRACT

A connector assembly is provided with an electric wire-side housing (51) to be fit on a device-side connector (10) that has relay terminals (20). Guide projections (58) project out from an outer peripheral surface of a wire-deriving tube (52) of the wire-side housing (51). The guide projections (58) guide a shielding tube (71) of a shielding shell (70) in position with respect to the wire-deriving tube (52). Therefore in fixing the shielding shell (70) to a connector-mounting member (40), an inner peripheral surface of the shielding tube (71) contacts the guide projections (58) of the wire-side housing (51) to fit the shielding shell (70) on the wire-side housing (51) without dislocation.

7 Claims, 12 Drawing Sheets

CONNECTOR ASSEMBLY WITH GUIDE PROJECTIONS

BACKGROUND OF THE INVENTION

1. Field of the Invention

The invention relates to a connector for supplying electric power to devices in a metal case.

2. Description of the Related Art

Japanese Patent Unexamined Publication No. 2006-31962 discloses a connector assembly for supplying electric power to devices of an electric car or the like, such as a motor accommodated inside a metal case. The connector assembly has a device-side connector and an electric wire-side connector. The device-side connector is mounted in a mounting hole that penetrates the metal case and the wire-side connector is mounted on an end of a wire harness. The connectors are fit together to connect terminals of the connectors to each other.

A relay terminal is held by the device-side connector and is long and narrow in the direction in which the two connectors are fit together. The relay terminal is connected to a motor winding. One end of the relay terminal projects in the direction in which the two connectors are fit together and is connected to an electric wire-side terminal of the wire-side connector.

A wire harness and a connector for use in a power circuit of an electric car and the like have a shielding means to prevent irradiation of electromagnetic waves. More specifically, the connector is covered with a shielding shell and a bolt fixes the shielding shell to the metal case that accommodates a motor to achieve grounding between the shield shell and the metal case. The wire harness is covered by a tube consisting of braided wires for collectively shielding the electric wires. An end of the braided wire tube is connected to the shielding shell.

The portion where the braided wire tube and the shielding shell are connected to each other has the following construction. A wire deriving tube projects from the end wire-side connector housing opposite the device-side connector, and the wire harness extends through the wire deriving tube. A shielding tube is formed on the shielding shell that covers the electric wire-side connector housing and covers the wire deriving tube so that a predetermined gap is defined between the electric wire-deriving tube and the shielding tube. The end of the braided wire tube is fit on the front end of the shielding tube. A caulking ring is caulked around the end of the braided wire tube to conductively fix the braided wire tube to the shielding shell.

A shell-mounting piece is provided on the end of shielding shell near the metal case and is used with a bolt to fix the shielding shell to the metal case so that the shielding shell covers the electric wire-side connector housing. Additionally, the shielding tube of the shielding shell surrounds the periphery of the wire deriving tube with a predetermined gap between the shielding tube and the wire deriving tube. Thus, the wire harness derived from the wire deriving tube is surrounded by the braided wire tube.

Assembly of the above-described connector requires the braided wire tube to be fit on the shielding tube of the shielding shell and the end of the braided wire tube then must be caulked with the caulking ring. The braided wire tube consists of narrow metal wires that can be caught by a sharp cut surface at an edge of the shielding tube, thereby preventing a rapid fit-on operation.

To overcome the above-described problem, the front edge of the shielding tube may be formed with an inwardly curved guide ring. The curved guide ring enables the braided wire tube to be fit easily on the shielding tube of the shielding shell. However, the front end of the wire deriving tube may catch the guide ring while fixing the shielding shell to the metal motor case, with the shielding shell placed on the wire-side connector housing.

The above-described problem is illustrated in FIG. 12, which shows a shielding shell 1 with a shielding tube 2 and a guide ring 3 that is curved in at the front end of the shielding tube 2. The shielding shell 1 is placed on a wire-side connector housing 4 and a mounting piece 6 of the shielding shell 1 is bolted to a metal motor case 7. The wire-side housing 4 has an electric wire deriving tube 5 that penetrates through the guide ring 3 of the shielding tube 2 as the shielding shell 1 is placed on the wire-side housing 4. Thus, the inside diameter of the guide ring 3 must exceed the outer diameter of the wire-deriving tube 5.

The wire deriving tube 5 is biased with respect to the shielding tube 2 while fitting the shielding shell 1 on the wire-side housing 4, as shown near the top of FIG. 12, and the front of the wire deriving tube 5 may strike the guide ring 3.

The guide ring 3 may be pressed against the front end surface of the wire deriving tube 5 at a strong force when the mounting piece 6 of the shielding shell 1 is bolted to the motor case 7. As a result, the guide ring 3 and the shielding shell 1 may be deformed or the wire deriving tube 5 and the wire-side housing 4 may generate an excessive stress. As a result, the wire deriving tube 5 and the wire-side housing 4 may break or deform.

The invention has been made in view of the above-described situation. Therefore an object of the invention is to provide a connector with a shielding shell and a wire-side housing that will not deform or otherwise malfunction while fixing the shielding shell to a motor case.

SUMMARY OF THE INVENTION

The invention relates to a connector assembly with an electric wire-side housing to be fit on a device-side connector that has relay terminals. Wire-side terminals are accommodated in the wire-side housing and are connected respectively to the relay terminals when the wire-side housing is fit on the device-side connector. An electric wire-deriving tube projects from an end of the wire-side housing opposite an end where the wire-side housing is fit on the device-side connector and electric wires connected with the wire-side terminals extend through the wire-deriving tube. A shielding shell is fit on the wire-side housing from the end with the wire-deriving tube and covers the wire-side housing. The shielding shell has a shielding tube that covers an outer side of the wire-deriving tube of the wire-side housing with a predetermined gap between the wire-deriving tube and the shielding shell. The shielding shell has a shell-mounting piece for bolting the shielding shell to a device, with the shielding tube positioned on a periphery of the wire-deriving tube and covering the wire-side housing. A braided wire tube surrounds the electric wires and an end of the braided wire tube is fit on a periphery of the shielding tube. A caulking ring caulked to an end of the braided wire tube while the braided wire tube is fit on the periphery of the shielding tube for fixing the braided wire tube to the shielding shell. A inwardly curved guide ring is formed at an edge of the shielding tube. Guides project on a peripheral surface of the wire-deriving tube or an inner peripheral surface of the shielding tube at positions symmetrical to an axis of the wire-deriving tube. The guides contact a mating side before the wire-deriving tube penetrates the shielding tube when fitting the shielding shell on the wire-side housing.

Thus, the guides guide the shielding tube into position with respect to the wire-deriving tube.

The shielding shell may incline or be biased relative to the wire-deriving tube as the shielding shell is being mounted to the wire-side housing. However, the guides correct a wrong positional relationship between the shielding shell and the wire-deriving tube.

The wire-deriving tube preferably is sectionally oblong and the guides preferably are formed integrally on the peripheral surface of the wire-deriving tube at positions symmetrical to a longitudinal axis of the sectionally oblong wire-deriving tube in a direction of a major transverse axis thereof.

The sectionally oblong shape of the wire-deriving tube facilitates the insertion of the electric wires, but makes the wire-deriving tube more likely to be caught by the guide ring if the shielding shell inclines in the major-axis direction of the wire-deriving tube. However, the above-described construction prevents the wire-deriving tubule from being caught by the guide ring.

Portions of the wire-side terminals that project beyond a front end of the wire-side housing preferably are plate shaped. These plate-shaped front portions of the wire-side terminals overlap the respective relay terminals in the device-side connector when the wire-side housing is fit on the device-side connector. Bolt insertion holes are formed at positions of contact between the device-side terminals and the wire-side terminals and receive connection bolts for tightening the device-side terminals and the wire-side terminals. The bolts can be tightened for strongly pressing the connection portions of the relay terminals and the wire-side terminals together. Therefore, the relay terminal and the electric wire-side terminal are connected with a high reliability.

The bolt insertion holes of the relay terminals and/or the wire-side terminals may be long in a direction in which the wire-side connector is fit on the device-side connector. These long bolt insertion holes overlap each other. The relay terminal and the wire-side terminal may be misaligned. However, the wire-side terminal and the relay terminal can be fixed securely together by the bolt, provided that the misalignment amount falls within the dimension of the long bolt insertion hole.

A working hole preferably is formed in a position of the device-side connector aligned with the bolt insertion holes of the relay terminals so that the connection bolts can be accessed and tightened.

The connector may further include a cap that can be mounted on the working hole. The cap preferably has a sealing ring for closely contacting a surface of the working hole and sealing a gap between the cap and the working hole. Thus, the cap and the sealing ring prevent water from penetrating into the working hole.

The above-described shielding shell and the wire-side housing are not likely to deform or otherwise malfunction.

DETAILED DESCRIPTION OF THE PREFERRED EMBODIMENTS

Figure 1:
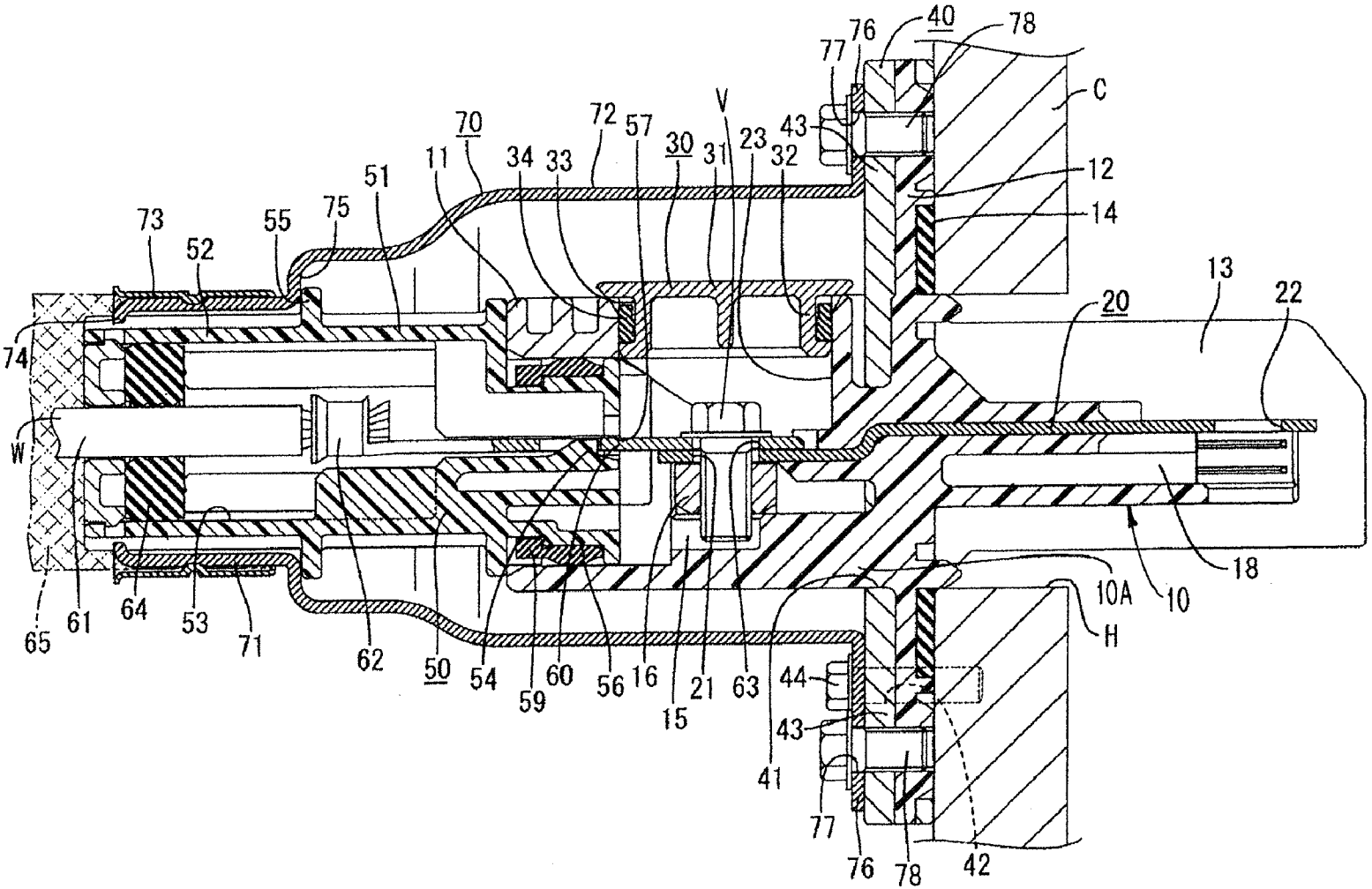
FIG. 1 is a sectional side elevation showing a state in which a device-side connector and an electric wire-side connector are fit on each other of a first embodiment of the invention.
Figure 2:
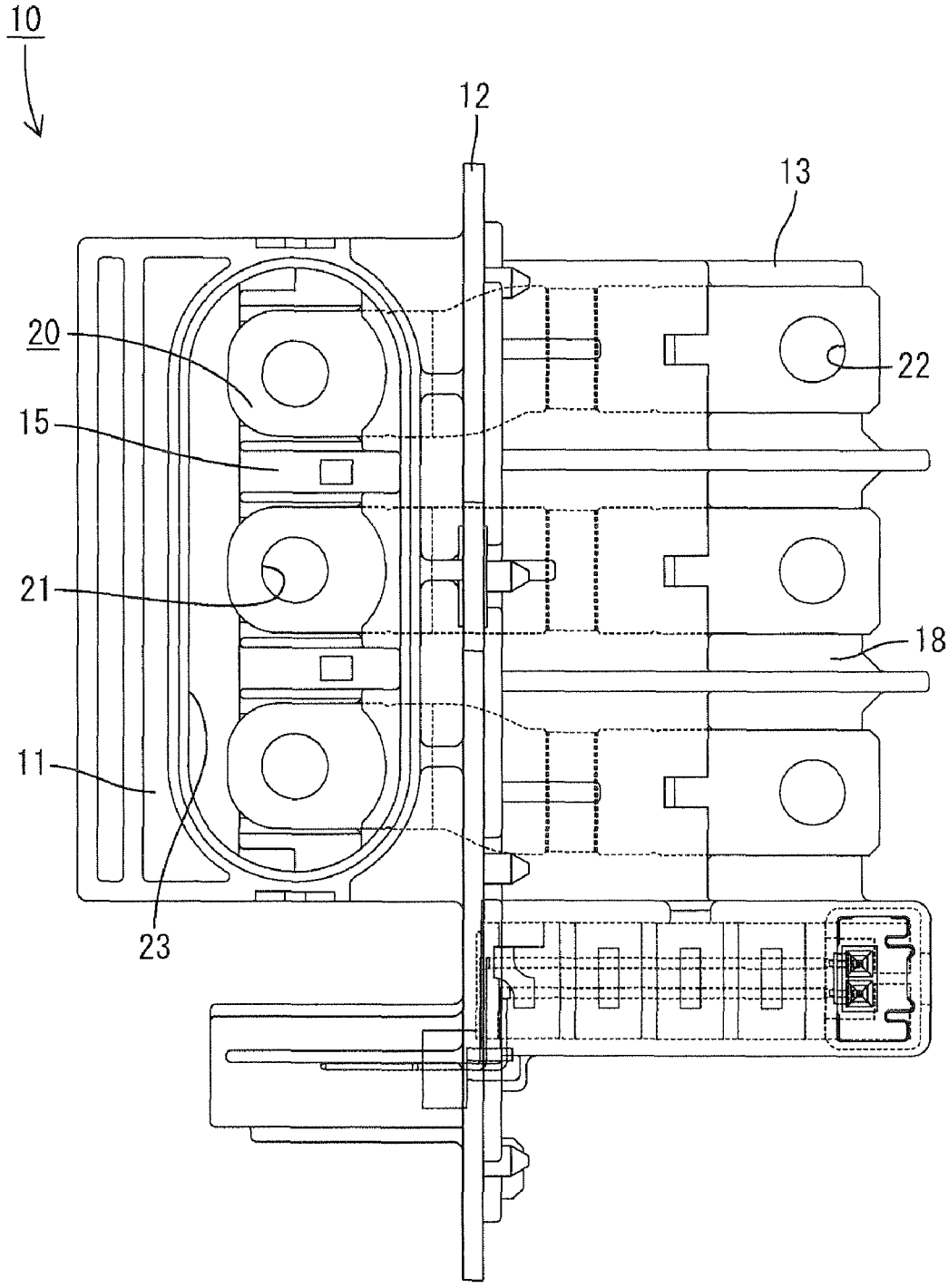
FIG. 2 is a plan view of the device-side connector.
Figure 3:
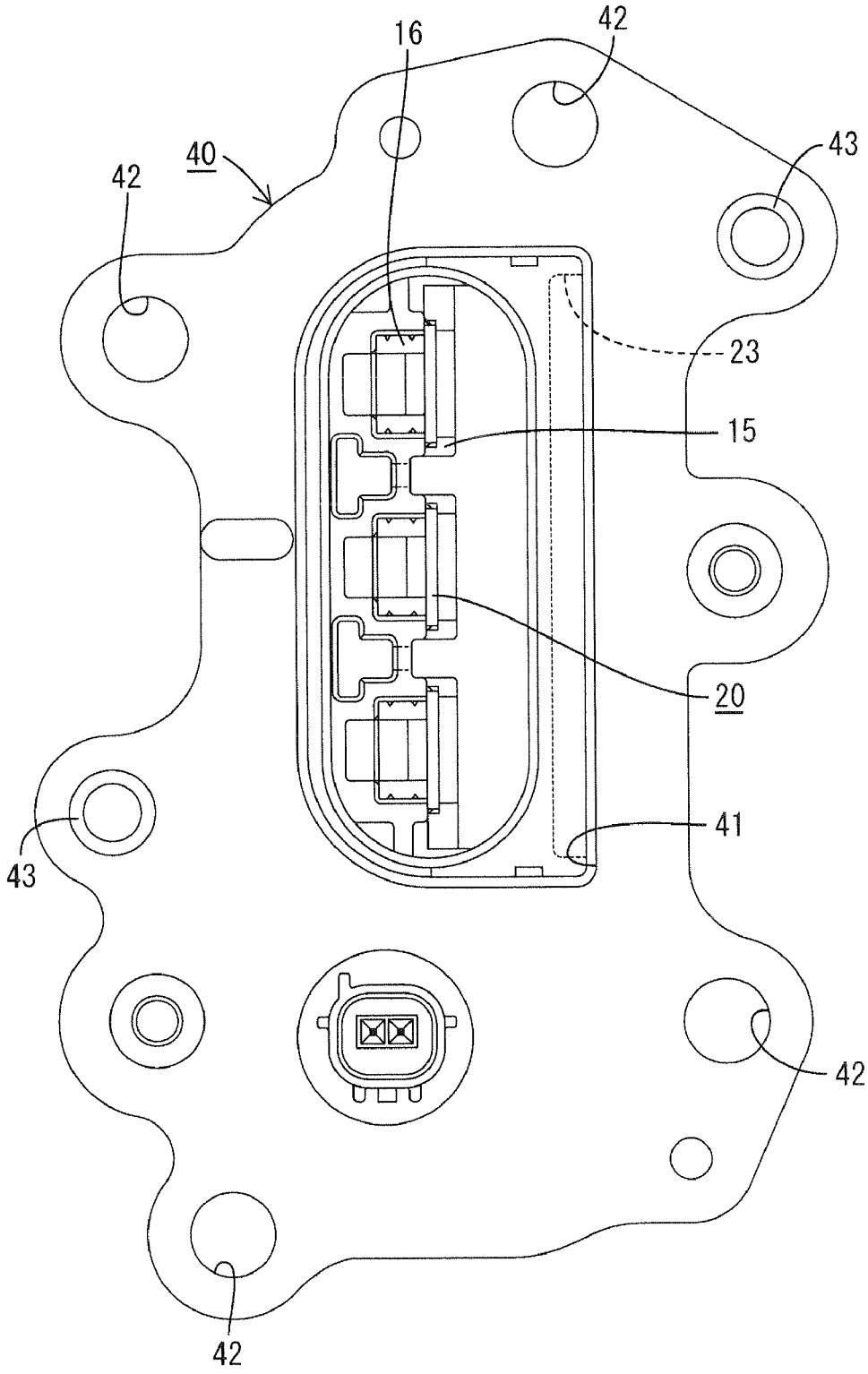
FIG. 3 is a front view of the device-side connector.
Figure 4:
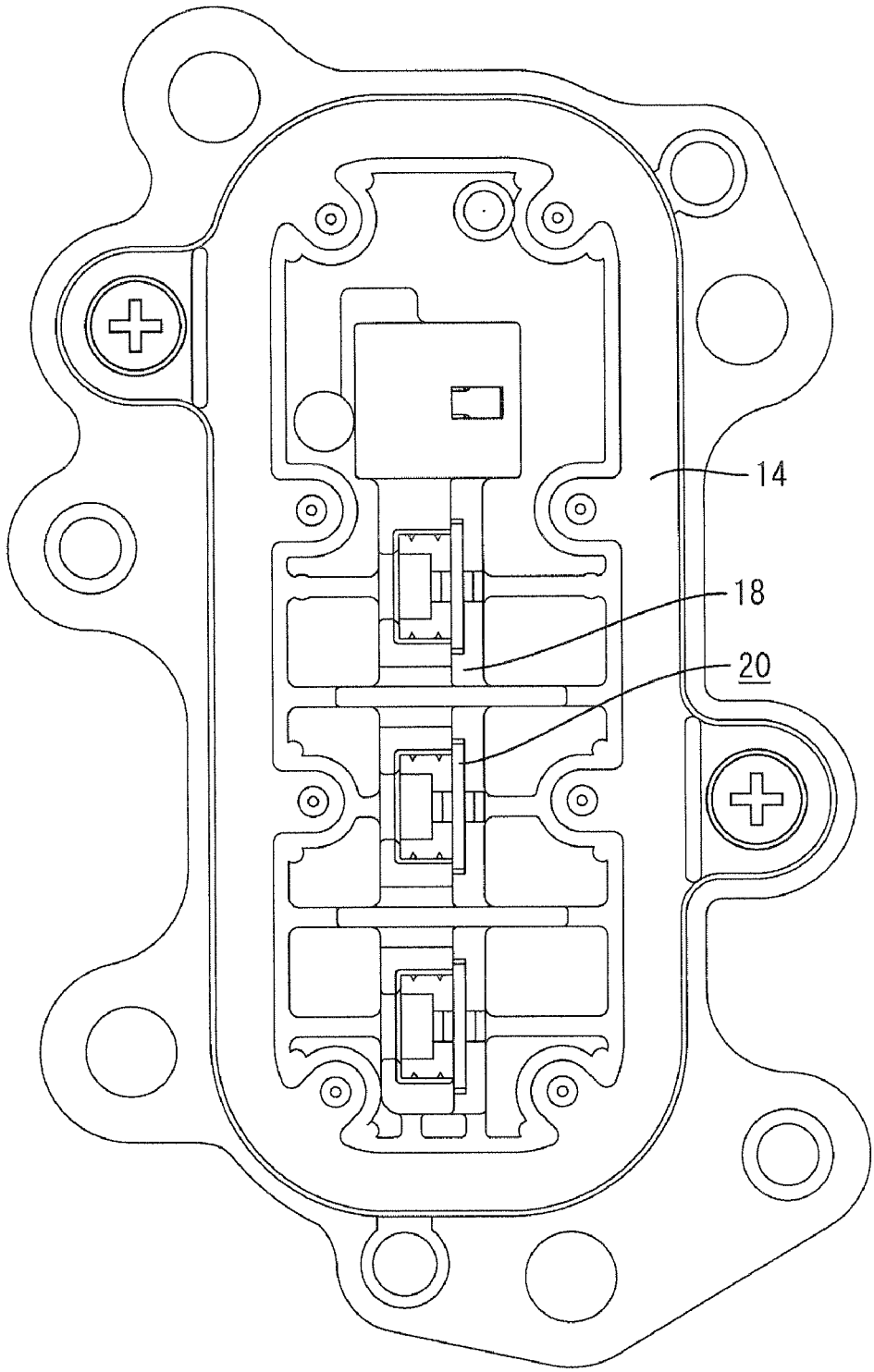
FIG. 4 is a rear view of the device-side connector.

A first embodiment of the invention is described below with reference to FIGS. 1 through 10. The connector assembly of the first embodiment supplies electric power to unshown equipment (for example, motor, inverter or the like mounted on a hybrid car or the like). The connector assembly includes a device-side connector 10 and an electric wire-side connector 50 to be fit on and separated from the device-side connector 10. Fit-on ends of the connectors 10, 50 are referred to as the front ends. The upper end of FIG. 1 is set as "upward", whereas the lower end is set as "downward". The devices are accommodated inside a metal case C that performs a shielding function and a mounting hole H penetrates the case C horizontally.

The device-side connector 10 has a device-side housing 10A made of synthetic resin and formed with a forwardly open hood 11. A plate-shaped flange 12 projects out from a rear end of the hood 11 and extends entirely around the outer periphery of the hood 11. A device-side connection portion 13 projects rearward from a rear surface of the flange 12.

The device-side housing 10A is mounted in the mounting hole H of the case C so that the hood 11 projects out from the case C and so that the device-side connection portion 13 is accommodated in the case C. Thus, the flange 12 is disposed along an outer surface of the case C. A seal 14 is mounted on the rear surface of the flange 12 closely contacts the outer surface of the case C to seal a gap between a peripheral portion of the mounting hole H and the device-side connector 10.

Three wire-side terminal blocks 15 are arranged side by side in the hood 11, and a nut 16 is accommodated in each of the wire-side terminal blocks 15. An axis of each nut 16 is disposed vertical to the direction in which the wire-side connector 50 is fit on the device-side connector 10 and a front surface of each nut 16 is flush with a front surface of the wire-side terminal block 15.

Three device-side terminal blocks 18 are arranged side by side at the device-side connection portion 13 and an unshown nut is accommodated in each device-side terminal block 18.

Three relay terminals 20 are integrated in the device-side connector 10 by insert molding. The relay terminals 20 extend from the wire-side terminal blocks 15 to the corresponding device-side terminal blocks 18.

Front bolt insertion holes 21 are formed at front ends of the relay terminals 20 and align coaxially with the respective nuts set in the wire-side terminal blocks 15. Rear bolt insertion holes 22 are formed at rear ends of the relay terminals 20 and align coaxially with the respective nuts set inside the device-side terminal blocks 18.

Unshown device-side terminals are connected with devices and overlap portions of the relay terminals 20 that overlap the device-side terminal blocks 18. Unshown bolts are inserted into bolt holes of the device-side terminals and into the bolt insertion holes 22 and are tightened into an unshown nut to connect the relay terminals 20 conductively with the device-side terminals.

A wide oblong working hole 23 is formed at a portion of an upper wall of the hood 11 directly above each wire-side terminal block 15. The three electric wire-side terminal blocks 15 are exposed upward in the hood 11 with the three electric wire-side terminal blocks 15 facing the working hole 23.

The device-side connector 10 has a cap 30 closing the working hole 23. The cap 30 has a wide oblong covering portion 31 that is larger than the working hole 23. A closing portion 32 projects down from a lower surface of the covering portion 31 and has an outer periphery that is almost the same as an inner periphery of the working hole 23. A mounting groove 33 is formed concavely on an entire peripheral surface of the closing portion 32 and a sealing ring 34 is mounted in the mounting groove 33. The sealing ring 34 closely contacts the inner peripheral surface of the working hole 23 when the working hole 23 is covered with the cap 30, thereby sealing the gap between the working hole 23 and the cap 30 and preventing water from penetrating into the hood 11 from the working hole 23.

A connector-mounting member 40 is mounted on the flange 12 of the device-side connector 10 and forms a part of the case C. The connector-mounting member 40 is formed by aluminum die casting. An approximately rectangular fit-on opening 41 (see FIG. 3) is formed through the connector-mounting member 40 by cutting out the connector-mounting member 40 along the outer configuration of the hood 11. The connector-mounting member 40 is configured to cover a front surface of the flange 12 and the entire peripheral surface thereof. The connector-mounting member 40 defines a wide rectangle when viewed from the front, and the fit-on opening 41 is shifted slightly (up in FIG. 3) with respect to a central position of the connector-mounting member 40.

Mounting screw insertion holes 42 are formed at four corners of the connector-mounting member 40 and align with unshown screw holes of the case C. The connector-mounting member 40 is fixed conductively to the case C by screws that pass through the mounting screw insertion holes 42 and the screw holes of the case C. At this time, the flange 12 of the device-side connector 10 is sandwiched between the outer surface of the case C and the connector-mounting member 40.

Screw-tightening portions 43 are provided at an upper corner of the connector-mounting member 40 and at approximately a central position of a lower side thereof to align with corresponding the screw holes of the case C. The fit-on opening 41 is sandwiched obliquely between the upper and lower screw-tightening portions 43. The upper and lower screw-tightening portions 43 project rearwardly. Screw holes are longitudinally formed.

The wire-side connector 50 has a wire-side housing 51 that is made of synthetic resin. Three cavities 53 are formed side by side in the wire-side housing 51 and are capable of accommodating the wire-side terminals 60 fixed to ends of electric wires 61. The wire-side terminals 60 can be inserted into the respective cavities 53 from the rear. A lance 54 is provided at a front end of the cavity 53 and engages the wire-side terminal 60 to prevent the terminal 60 from being removed therefrom.

A front stopping wall 55 projects out from the outer peripheral surface of the wire-side housing 51 at a position slightly rearward from a longitudinal central position and extends entirely around the periphery of the wire-side housing 51. A contact wall 75 of a shielding shell 70 contacts the front stopping wall 55 from the rear.

Figure 5:
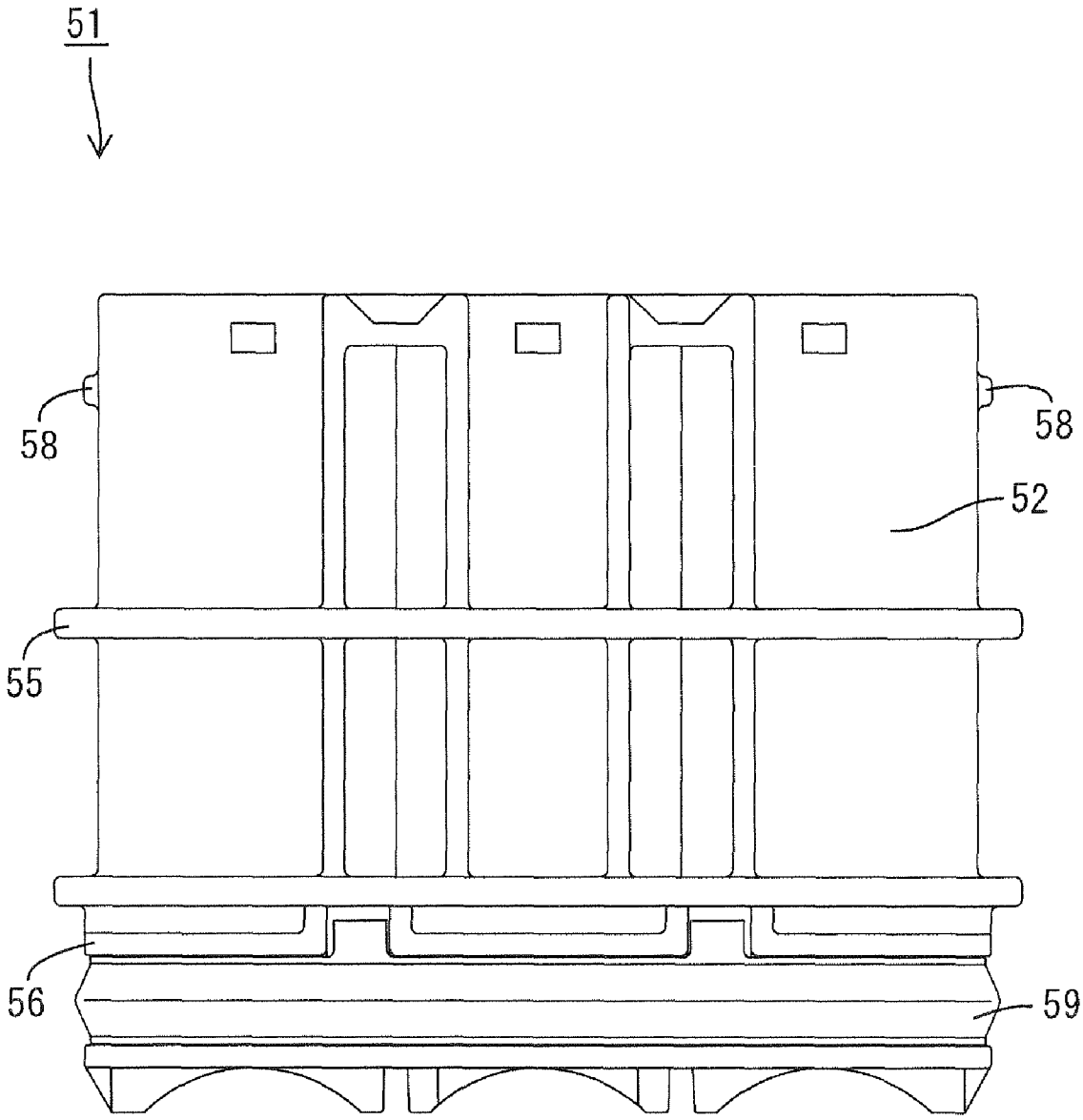
FIG. 5 is a plan view of the electric wire-side connector.

A wire-side hood 56 is formed at a front end of the wire-side housing 51 and can be fit into the hood 11 of the device-side connector 10. A sealing ring 59 is mounted at a front end of a peripheral surface of the electric wire-side hood 56. The sealing ring 59 closely contacts an inner peripheral surface of the hood 11 when the wire-side hood 56 is fit in the hood 11, as shown in FIG. 5. Thus, the sealing ring 59 seals a gap between the outer peripheral surface of the electric wire-side hood 56 and the inner peripheral surface of the hood 11 to prevent water from penetrating into the hood 11.

The wire-side terminals 60 are long and have opposite front and rear ends. A crimping portion 62 is formed at the rear end of each of the wire-side terminal 60 and is configured to be crimped to the end of the corresponding electric wire 61 of a wire harness W. A bolt insertion hole 63 is formed at the front end of each wire-side terminal 60. The bolt insertion holes 63 extend forward from a terminal insertion hole 57 in a front wall of the wire-side hood 56 when the wire-side terminals 60 are accommodated in the respective cavities 53. The bolt insertion hole 63 overlaps an upper surface of the bolt insertion hole 21 of the relay terminal 20 when the wire-side connector 50 is fit on the device-side connector 10. The bolt insertion hole 63 is slightly larger than the bolt insertion hole 21 of the relay terminal 20 and defines an oblong with a length slightly greater than the width thereof. A rubber stopper 64 is fit on each wire 61 to seal the gap between the wire 61 and the cavity 53.

The wire-side housing 51 has a wire-deriving tube 52 and guide projections 58 project out from both widthwise side surfaces of the wire-deriving tube 52, as shown in FIG. 5. The guide projections 58 contact an inner peripheral surface of a shielding tube 71 before the wire-deriving tube 52 penetrates through the shielding tube 71 when fitting the shielding shell 70 on the wire-side housing 51. Thus, the shielding shell 70 is fit on the wire-side housing 51 without dislocation.

The shielding shell 70 is mounted on the wire-side housing 51 from the rear. The shielding shell 70 is produced by press working a steel plate. The shielding shell 70 has a tubular body 72 that covers a part of the wire-side housing 51 forward from the front stopping wall 55 and a shielding tube 71 that covers a part of the wire-side housing 51 rearward from the front stopping wall 55 when the wire-side housing 51 is fit on the device-side connector 10.

Figure 6:
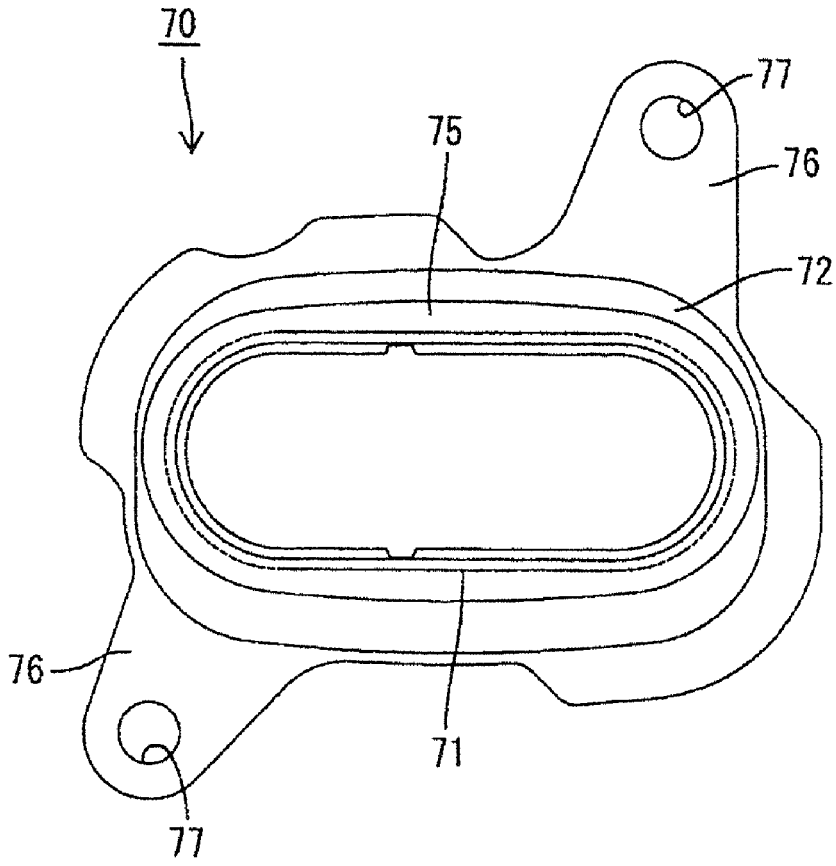
FIG. 6 is a front view of a shielding shell.

Upper and lower shell-mounting pieces 76 extend up and down at an open front edge of the body 72 of the shielding shell 70, as shown in FIG. 6, and a shell-side screw insertion hole 77 is formed at an extended end of each shell-mounting piece 76. The shell-mounting pieces 76 are formed so as not to protrude sideways from the body 72. The shell-side screw insertion holes 77 are disposed to align with the screw holes of the upper and lower screw-tightening portions 43 (see FIG. 3) respectively.

The body 72 of the shielding shell 70 has a wide generally rectangular shape when viewed from the front, and the shielding tube 71 defines a wide oblong slightly smaller than the body 72. A contact wall 75 is formed on a rear surface of the body 72 and can contact the front stopping wall 55 of the wire-side housing 51 from the rear.

Figure 7:
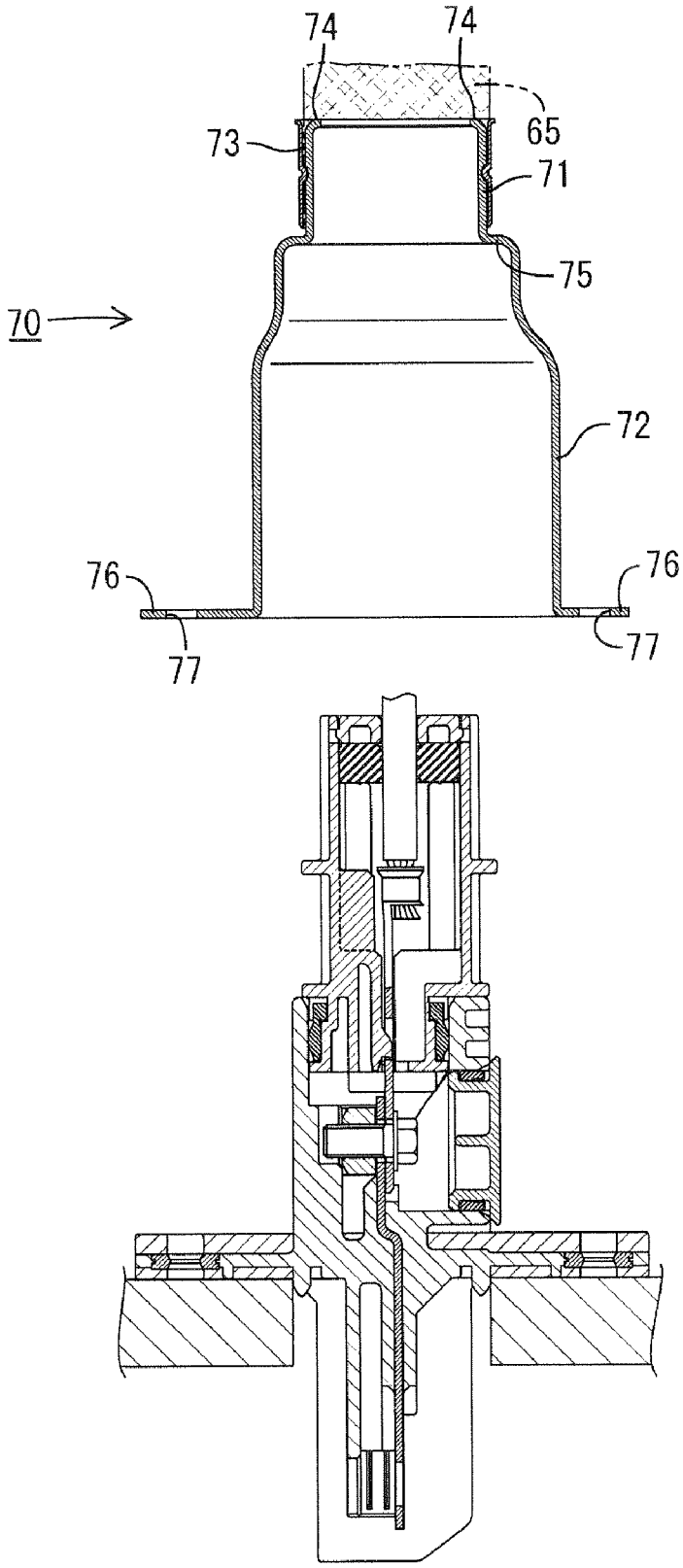
FIG. 7 is a sectional side elevation before the shielding shell is mounted on both the device-side connector and the electric wire-side connector fitted thereon.
Figure 8:
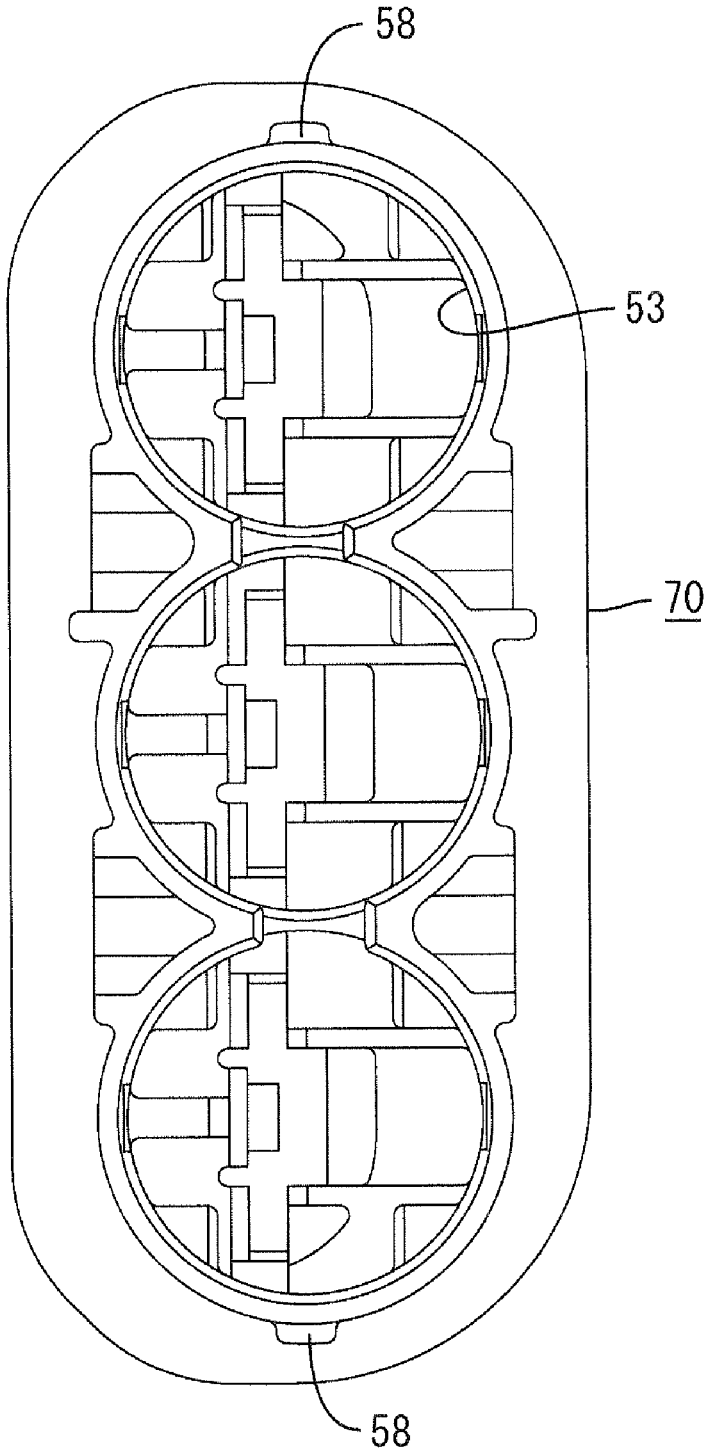
FIG. 8 is a front view of the electric wire-side connector on which the shielding shell is mounted.
Figure 9:
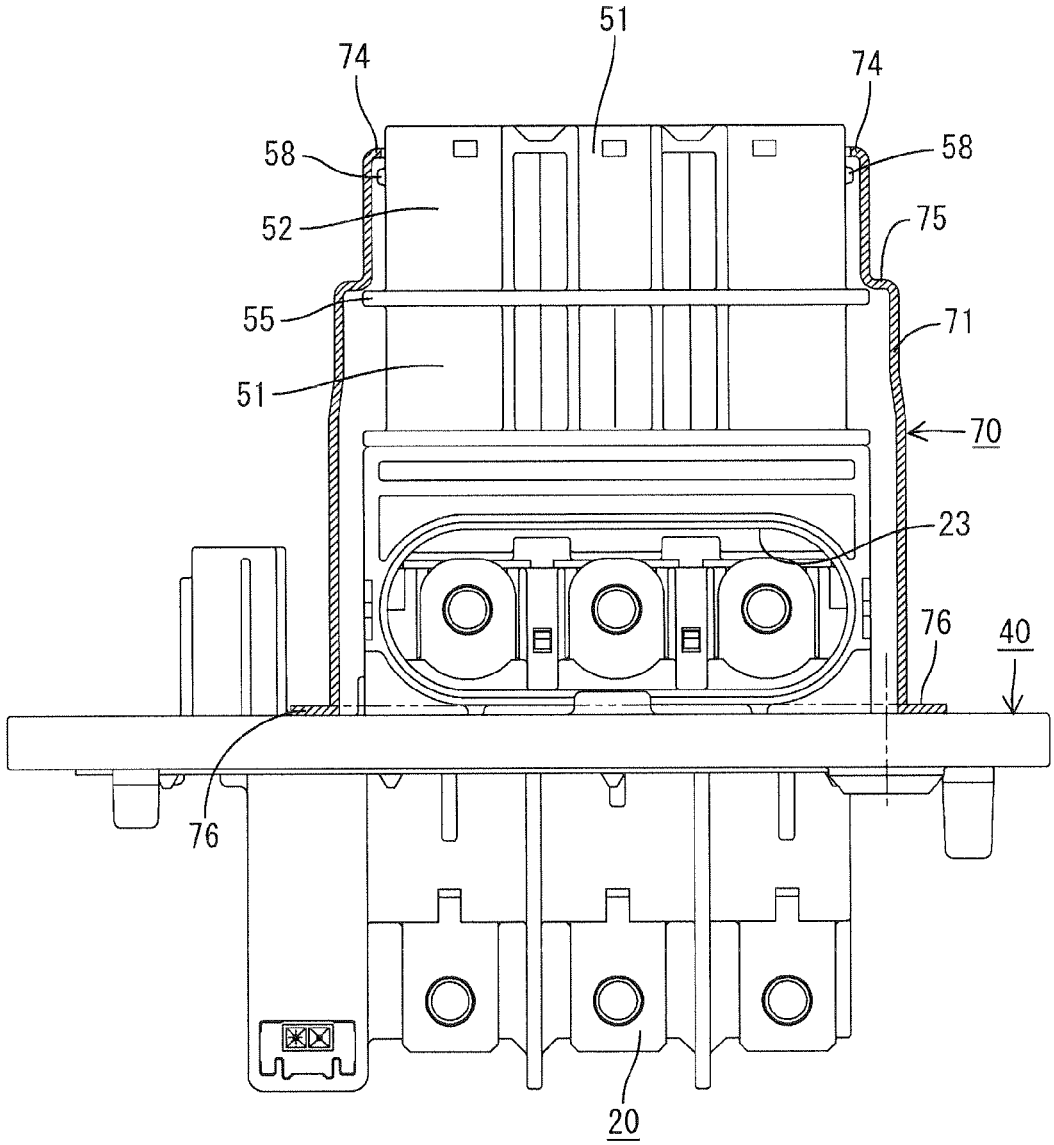
FIG. 9 is a plan view of the electric wire-side connector on which the shielding shell is mounted.
Figure 10:
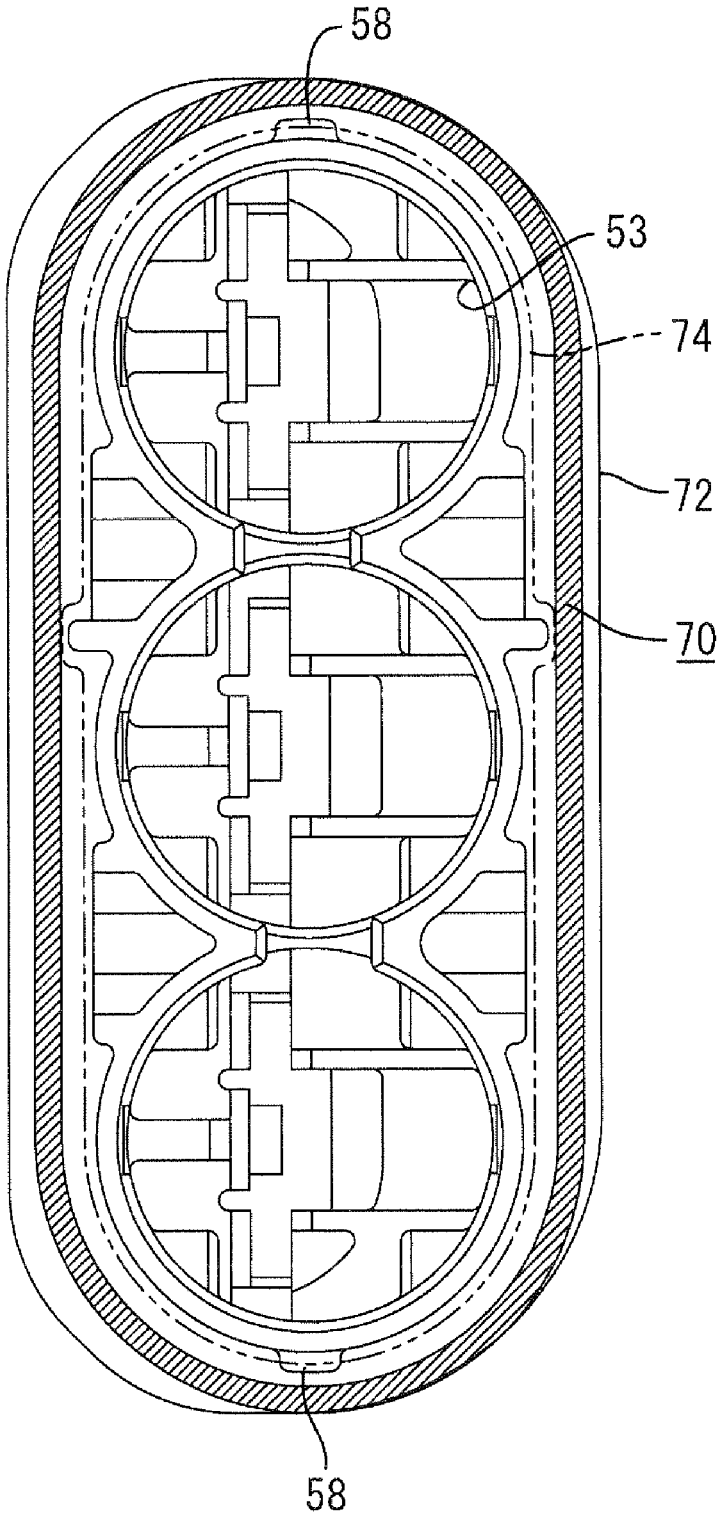
FIG. 10 is a front view of FIG. 9.

A braided wire tube 65 collectively surrounds the three electric wires 61 to define a wire harness W and an end of the braided wire tube 65 is fit on the peripheral surface of the shielding tube 71, as shown in FIG. 7. A caulking ring 73 fixes the braided wire tube 65 is fixed conductively to the shielding tube 71.

A guide ring 74 is curved in at a front end of the shielding tube 71.

The wire-side hood 56 of the wire-side housing 51 initially is fit on the device-side connector 10 from the front of the hood 11 while the shielding shell 70 is disposed rearward from the wire-side housing 51. As a result, the bolt insertion holes 63 of the wire-side terminals 60 are disposed in overlaying relationship to the bolt insertion holes 21 of the relay terminals 20 at the rear end of the hood 11 (see FIG. 1). At this time, the working hole 23 is open because the shielding shell 70 is disposed rearward. A bolt V is inserted through the working hole 23 and into bolt insertion hole 21 of the relay terminal 20 and the bolt insertion hole 63 of the electric wire-side terminal 60. The bolt V then is tightened into the nut 16 of the wire-side terminal block 15 to fix the bolt.

The working hole 23 is covered by the cap 30 after the bolts are tightened into the bolt insertion hole 63 of the wire-side terminal 60 and the bolt insertion hole 21 of the relay terminal 20. The closing portion 32 of the cap 30 fits into the working hole 23 and the covering portion 31 of the cap 30 is mounted on the hood 11.

The shielding shell 70 is slid forward after the cap 30 is mounted on the working hole 23 to bring the inner side of the shielding tube 71 into contact with the guide projection 58 of the wire-side housing 51. Thus, the shielding shell 70 can be mounted on the wire-side housing 51 without dislocation. The front end of the shielding shell 70 contacts the front surface of the connector-mounting member 40 when the contact wall 75 of the shielding shell 70 contacts the front stopping wall 55 of the wire-side housing 51. Additionally the connector-mounting member 40 and the shielding shell 70 cover and shield the hood 11 and the electric wire-side hood 56. The shell-side screw insertion holes 77 of the shielding shell 70 align with the front surfaces of the upper and lower screw-tightening portions 43 of the connector-mounting member 40. Thus, screws 78 are inserted through the shell-side screw insertion holes 77 to engage the screw holes of the upper and lower screw-tightening portions 43. as a result, the shielding shell 70 is fixed conductively to the connector-mounting member 40. A screw 44 is inserted into the mounting screw insertion hole 42 of the connector-mounting member 40 and is tightened to fix the shielding shell 70 and the connector-mounting member 40 conductively to the case C.

The bolt insertion hole 63 of the wire-side terminal 60 of the first embodiment is slightly larger than the bolt insertion hole 21 of the relay terminal 20. Additionally, the bolt insertion hole 63 is an oblong with a length that is slightly longer than the width. As described above, the bolt insertion holes 21, 63 overlap. Therefore, the bolt can be inserted through the bolt insertion holes 21, 63 and tightened to a nut even if the bolt insertion holes 21, 63 are misaligned, provided that the misalignment falls within the dimension of the bolt insertion hole 63. The bolt insertion hole 63 of the wire-side terminal 60 is elongated in the direction in which the terminals 20, 60 are liable to be misaligned, namely, in the direction in which the wire-side connector 50 is fit on the device-side connector 10. Hence there is no need to enlarge the bolt insertion hole 63 in other directions.

The working hole 23 is slightly larger than necessary so that a tool, such as an impact wrench, can be inserted therein to tightening the bolt V. Thus the bolt-tightening operation can be performed easily.

The working hole 23 is exposed when the shielding shell 70 is held at the rear position. Additionally, the bolt insertion hole 63 of the wire-side terminal 60 at least partly aligns with the bolt insertion hole 21 of the relay terminal 20 so that the bolt can be tightened therein. The shielding shell 70 then is slid to the position where the shielding shell 70 covers the working hole 23 to bring the guide projection 58 of the electric wire-side connector housing 51 into contact with the inner peripheral surface of the shielding tube 71. In this manner, the shielding shell 70 is fixed to the connector-mounting member 40 without dislocation. Thereby in fixing the shielding shell 70 to the connector-mounting member 40, it does not occur that the front end of the wire-deriving tube 52 is caught by the guide ring 74 and that the shielding shell 70 and the electric wire-side connector housing 51 do not have malfunction such as deformation.

A second embodiment is described below with reference to FIG. 11.

The second embodiment is different from the first embodiment in the positions and number of the guide projections 58. Because other constructions of the second embodiment are similar to the first embodiment, descriptions thereof are omitted.

Figure 11:
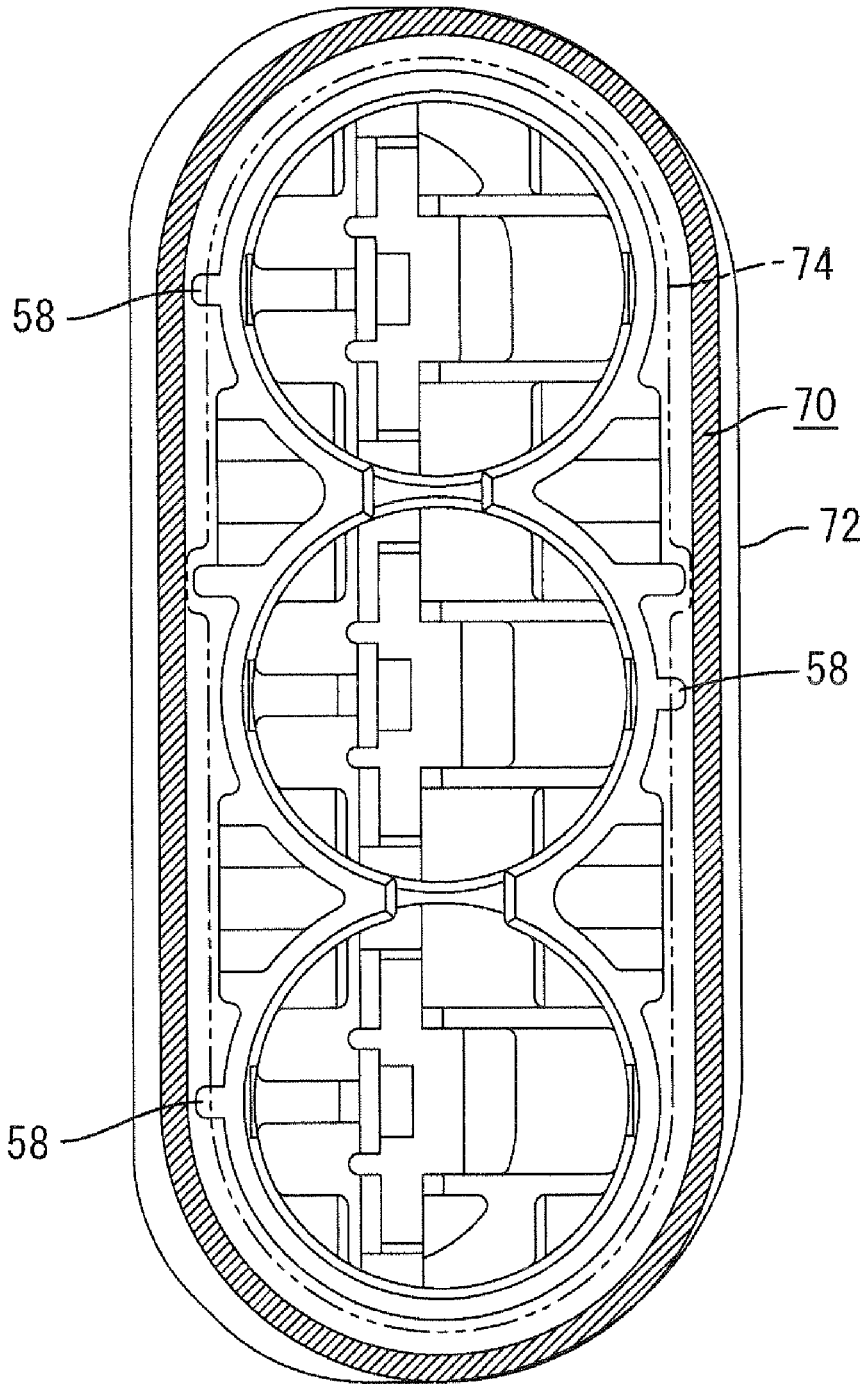
FIG. 11 is a front view of FIG. 9 in a second embodiment.
Figure 12:
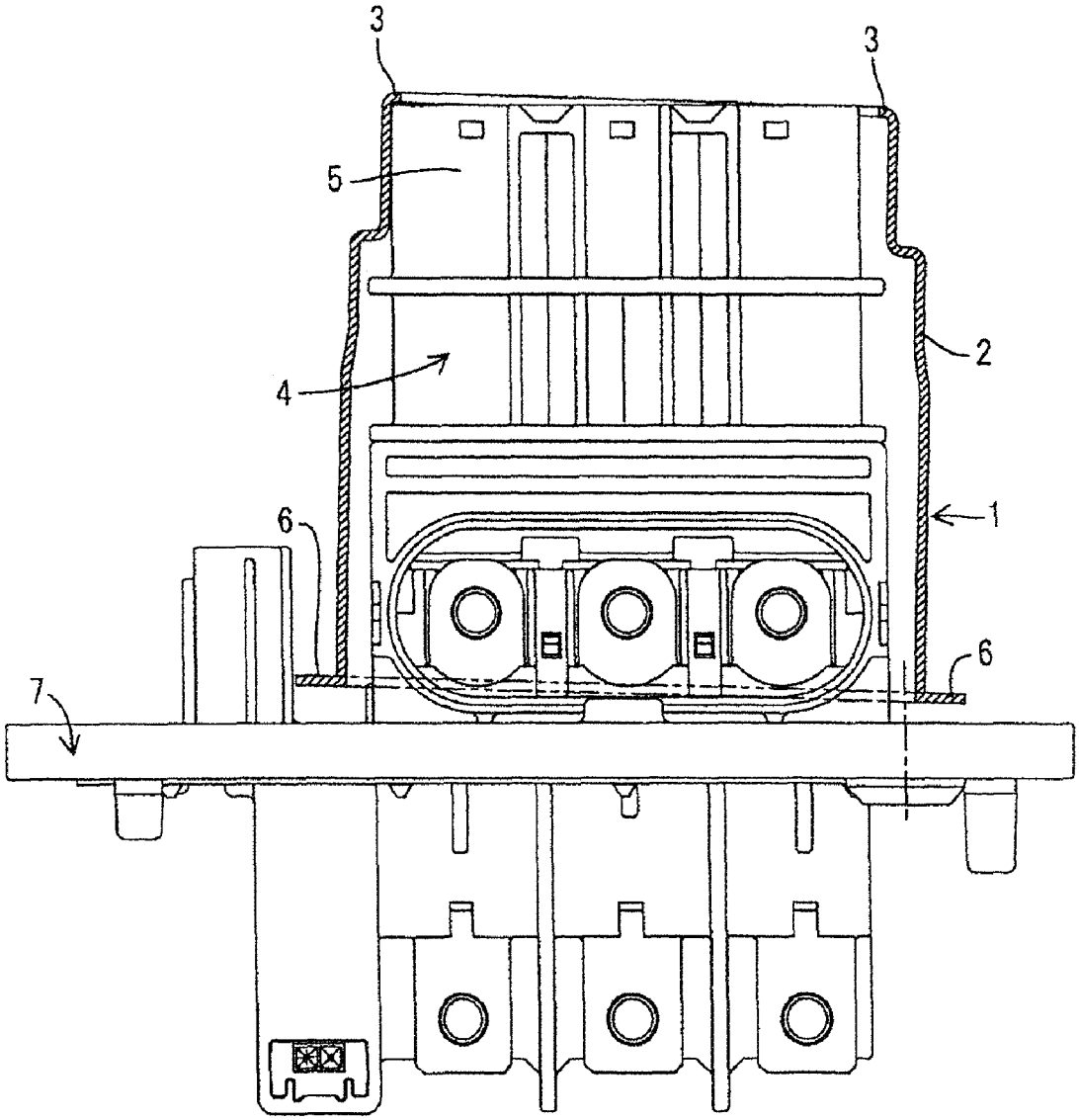
FIG. 12 PRIOR ART
FIG. 12 shows a problem of a conventional construction to be solved by the present invention.

As shown in FIG. 11, three guide projections 58 are formed on upper and lower surfaces of the wire-deriving tube 52. The guide projections 58 are disposed equiangularly with respect to the axis of the wire-deriving tube 52 and contact the inner peripheral surface of the shielding tube 71 before the wire-deriving tube 52 penetrates through the shielding tube 71 while fitting the shielding shell 70 on the wire-side housing 51. Thus, a uniform gap is kept between the shielding tube 71 and the wire-side housing 51.

The guide projections 58 of the second embodiment are similar to the first embodiment in that the shielding shell 70 can be fit on the wire-side housing 51 without dislocation. Two guide projections 58 are brought into contact with the inner peripheral surface of the shielding tube 71 in the first embodiment. On the other hand, three guide projections 58 are brought into contact with the inner peripheral surface of the shielding tube 71 in the second embodiment. Therefore, the second embodiment enables the shielding shell 70 to be fit on the entire peripheral surface of the wire-side housing 51 more stably than that of the first embodiment.

The invention is not limited to the embodiments described above with reference to the drawings. For example, the following embodiments also are included in the scope of the invention.

In the above-described embodiments, the guide projections 58 are formed on both widthwise side surfaces of the wire-deriving tube 52 of the wire-side housing 51 by projecting the guide projections 58 outward. However, the guide projections 58 may be projected from the peripheral surface of the wire-deriving tube 52 or from the inner peripheral surface of the shielding tube 71 symmetrically with respect to the axis of the wire-deriving tube.

The bolt insertion hole 63 of the wire-side terminal 60 of the above-described embodiments is slightly larger than the bolt insertion hole 21 of the relay terminal 20. Additionally, the longitudinal dimension of the bolt insertion hole 63 exceeds the lateral dimension thereof. Thus the bolt insertion hole 63 is oblong. However, the bolt insertion holes 21 and 63 may have equal size. Alternatively, the bolt insertion hole 21 of the relay terminal 20 may be larger than the bolt insertion hole 63 of the wire-side terminal 60.

The cap 30 closes the working hole 23 of the above-described device-side connector 10. However, the cap 30 is not required.

The cap 30 of the above-described embodiments has the sealing ring 34. However, the sealing ring 34 can be omitted.

What is claimed is:

1. A connector assembly comprising: a device-side connector having device-side terminals; a wire-side housing having a front end to be fit on the device-side connector and a rear end defining a wire-deriving tube; wire-side terminals accommodated in the wire-side housing and connected to wires projecting through the wire-deriving tube, the wire-side terminals being connected respectively to the device-side terminals when the wire-side housing is fit on said device-side connector; a shielding shell fit on and shielding the wire-side housing, the shielding shell having a shielding tube covering an outer side of said wire-deriving tube and shell-mounting pieces for bolting said shielding shell to a device, a guide ring curved in at an edge of said shielding tube; a braided wire tube surrounding said wires and having an end fit on a periphery of said shielding tube; and guide projections extending between an outer peripheral surface of the wire-deriving tube and an inner peripheral surface of said shielding tube for positioning said shielding tube with respect to said wire-deriving tube before the wire-deriving tube penetrates through the shielding tube while fitting the shielding shell on the wire-side housing.

2. The connector assembly of claim 1, wherein said wire-deriving tube is sectionally oblong, said guide projections being formed integrally on said peripheral surface of said wire-deriving tube at positions symmetrical with respect to a longitudinal axis of said wire-deriving tube in a direction of a major transverse axis thereof.

3. The connector assembly of claim 1, wherein said wire-side terminals have plate-shaped portions projected beyond a front end of said wire-side housing and contacting said respective device-side terminals accommodated in the device-side connector when said wire-side housing is fit on said device-side connector, bolt insertion holes are formed at positions of contact between the device-side terminals and the wire-side terminals for receiving connection bolts for tightening said device-side terminals and said wire-side terminals.

4. The connector assembly of claim 3, wherein said bolt insertion holes in at least one of said device-side terminals and said wire-side terminals are long in a direction in which said wire-side housing is fit on said device-side connector.

5. The connector assembly of claim 1, wherein said device-side connector has a working hole at corresponding to said bolt insertion holes of said device-side terminals for accessing the connection bolts.

6. The connector assembly of claim 5, further comprising a cap mounted on said working hole; and said cap having a sealing ring for sealing a gap between said cap and said working hole with said sealing ring in close contact with a surface of said working hole.

7. The connector assembly of claim 1, further comprising a caulking ring caulked to an end of the braided wire tube and fixing said braided wire tube to said shielding shell.

* * * * *